US009439509B2

(12) United States Patent
Cammarata

(10) Patent No.: US 9,439,509 B2
(45) Date of Patent: Sep. 13, 2016

(54) REMOVABLY ATTACHABLE AND ADJUSTABLE OUTDOOR FURNITURE WEIGHTS

(71) Applicant: CNC COMMERCIAL GROUP, LLC, O'Fallon, MO (US)

(72) Inventor: Christy Cammarata, O'Fallon, MO (US)

(73) Assignee: CNC Commercial Group, LLC, O'Fallon, MO (US)

( * ) Notice: Subject to any disclaimer, the term of this patent is extended or adjusted under 35 U.S.C. 154(b) by 150 days.

(21) Appl. No.: 14/450,814

(22) Filed: Aug. 4, 2014

(65) Prior Publication Data

US 2016/0029792 A1 Feb. 4, 2016

Related U.S. Application Data

(60) Provisional application No. 61/958,612, filed on Aug. 2, 2013.

(51) Int. Cl.

| | |
|---|---|
| ***A47B 91/04*** | (2006.01) |
| ***A47B 91/06*** | (2006.01) |
| ***A47C 1/14*** | (2006.01) |
| ***A47C 7/00*** | (2006.01) |
| *A47B 37/04* | (2006.01) |

(52) U.S. Cl.

CPC ..... *A47B 91/06* (2013.01); *A47C 1/143* (2013.01); *A47C 7/002* (2013.01); *A47B 37/04* (2013.01)

(58) Field of Classification Search

CPC .... A47B 91/06; A47B 91/08; Y10T 16/209; Y10T 16/21; Y10T 16/191; E04H 12/2246; A63B 2071/026; G03B 17/56; F16M 13/02; F16M 11/00; Y10S 248/91

USPC ..... 248/346.2, 501, 910, 188.9

See application file for complete search history.

(56) References Cited

U.S. PATENT DOCUMENTS

| | | | | |
|---|---|---|---|---|
| 2,448,413 | A * | 8/1948 | Borghesi | F21V 21/06 248/188.1 |
| 2,716,255 | A * | 8/1955 | Laure | A47B 91/04 16/42 R |
| 3,254,362 | A * | 6/1966 | Rasor | A47B 91/06 16/42 R |
| 3,623,184 | A * | 11/1971 | Mazur | A47B 91/00 16/42 R |
| 3,664,275 | A | 5/1972 | Kieinert | |
| 3,747,887 | A | 7/1973 | Binkley | |
| 4,384,857 | A | 5/1983 | Hoy, Jr. | |
| 5,513,900 | A | 5/1996 | Iglesias | |
| 5,680,673 | A * | 10/1997 | Beshore | A47B 91/06 16/42 R |
| 5,820,217 | A * | 10/1998 | Horner | A47B 91/06 248/188.8 |
| 6,290,197 | B1 | 9/2001 | Newton | |

(Continued)

OTHER PUBLICATIONS

Instructions for installing 10 pound weighted crossbar Telescope Casual Furniture Nov. 9, 2011.

*Primary Examiner* — Victor Batson
*Assistant Examiner* — Matthew Sullivan
(74) *Attorney, Agent, or Firm* — Joseph M. Rolnicki; Evans & Dixon, LLC.

(57) ABSTRACT

A glide foot for outdoor furniture is removably attachable to a bottom surface of a piece of outdoor furniture to protect the bottom surface of the furniture from being scratched or otherwise damaged from abrasive outdoor surfaces, for example a patio surface. The glide foot also adjustably adds weight to the furniture to stabilize the furniture in windy conditions without detracting from the aesthetic appearance of the furniture.

20 Claims, 5 Drawing Sheets

(56) References Cited

U.S. PATENT DOCUMENTS 6,869,058 B2 * 3/2005 Tung ..... E04H 12/2238 248/519
7,293,840 B1 11/2007 Schu
7,614,600 B1 * 11/2009 Smith ..... G09F 23/00 135/16
7,837,161 B2 * 11/2010 Chase ..... A47B 91/06 16/42 T
8,726,463 B2 * 5/2014 Bushey ..... A47B 91/06 16/42 R
2010/0326329 A1 12/2010 Kiekhaeffer
2012/0248843 A1 10/2012 Sinchok
2013/0127228 A1 5/2013 Colvin

* cited by examiner

REMOVABLY ATTACHABLE AND ADJUSTABLE OUTDOOR FURNITURE WEIGHTS

This patent application claims the benefit of the Aug. 2, 2013 filing date of provisional patent application Ser. No. 61/958,612.

FIELD

This disclosure pertains to a glide foot for a piece of outdoor furniture. In particular, this disclosure pertains to a glide foot for outdoor furniture that functions to protect a bottom surface of the furniture from being scratched or otherwise damaged by an abrasive outdoor surface on which the furniture is placed and also adds weight to the piece of outdoor furniture to stabilize the furniture in windy conditions.

BACKGROUND

Outdoor furniture, for example patio outdoor furniture, deck outdoor furniture, pool outdoor furniture, etc. are typically constructed to be lightweight to enable the furniture to be easily manually moved about their environment. However, the lightweight construction of typical outdoor furniture makes the furniture prone to being blown around or blown over in windy conditions. This is particularly true for outdoor furniture placed on a roof top sundeck or pool deck of a high-rise apartment building or hotel.

Attempts have been made to make outdoor furniture more stable in windy conditions by adding weight to the furniture. However, these attempts often detract from the aesthetically pleasing appearance of the furniture.

SUMMARY

This disclosure pertains to a glide foot for outdoor furniture that is removably attachable to a bottom surface of a piece of outdoor furniture to protect the bottom surface of the furniture from being scratched or otherwise damaged from abrasive outdoor surfaces, for example a patio surface. The glide foot also adjustably adds weight to the furniture to stabilize the furniture in windy conditions without detracting from the aesthetic appearance of the outdoor furniture.

The glide foot includes a housing that is constructed of a plastic material or other equivalent material that is conventionally used in constructing a glide foot for outdoor furniture. The housing is constructed with a hollow interior. The housing is also constructed to be easily removably attachable to the bottom surface of the piece of outdoor furniture by a snap-on connection, a removal fastener connection or other equivalent means. The glide foot housing attached to the bottom protects the surface of the furniture from damage when the furniture is placed on an abrasive surface.

An amount of material is provided inside the housing interior. The added material adds weight to the glide foot. In one embodiment, the amount of material is a solid piece of material and the glide foot housing is molded around the solid piece of material encapsulating the material. Changing the size of the solid piece of material adjustably changes the weight that the glide foot can add to a piece of outdoor furniture when removably attached to the piece of outdoor furniture.

In another embodiment the housing of the glide foot is provided with one or more holes bored into the housing that form the hollow interior in the housing. The amount of material added to the hollow interior of the housing is shaped as a rod. The holes in the housing and the rod have complementary cross-section configurations, enabling the rod to be inserted into the hole. By providing a plurality of holes in the housing and a corresponding plurality of rods, selectively positioning a number of the plurality of rods in the housing holes adjusts the weight of the housing. The rods positioned in the housing holes can be secured in the holes by adhesives or other equivalent means.

A plurality of the glide foot housings can be attached at different locations on the bottom surfaces of a piece of outdoor furniture to adjustably add to the weight of the furniture. With the solid piece of material and the rods being concealed in the interiors of the glide foot housings, and the glide foot housings having the aesthetic appearance of a typical outdoor furniture glide foot, the glide foot housings of this disclosure adjustably add weight to the furniture without detracting from the aesthetic appearance of the furniture.

BRIEF DESCRIPTION OF THE DRAWINGS

Further features of the glide foot of this disclosure are set forth in the following detailed descriptions of the glide foot and the drawing figures.

DETAILED DESCRIPTION

Figure 1:
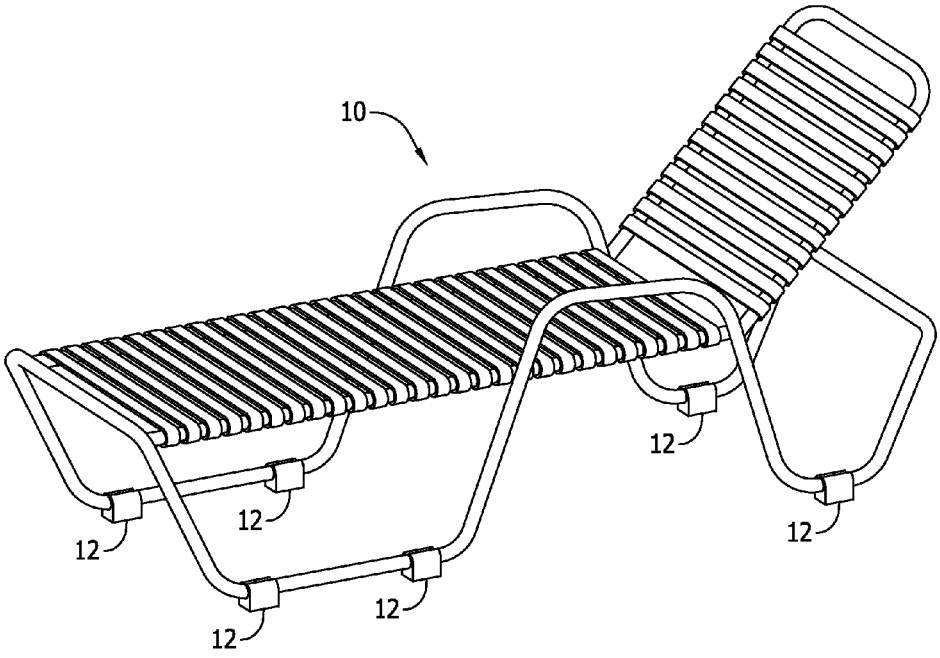
FIG. 1 is a representation of a perspective view of a piece of outdoor furniture having glide feet of this disclosure removably attached to bottom surfaces of the furniture.

FIG. 1 is a representation of a perspective view of a piece of outdoor furniture 10 employing the glide feet 12 of this disclosure. Although the piece of outdoor furniture 10 represented in FIG. 1 is a chaise lounge, it should be understood that the glide feet 12 of this disclosure can be employed on any type of outdoor furniture, for example chairs, tables, ottomans, etc. Additionally, although the glide feet 12 are shown attached to horizontal members of the furniture 10, the glide feet 12 could be adapted to be removably attached to vertical members of the furniture. As represented in FIG. 1, the glide feet 12 are removably attached to the piece of outdoor furniture 10 on bottommost surfaces of the furniture. The glide feet 12 removably attached to the bottommost surfaces of the furniture 10 protect the bottommost surfaces from being scratched or otherwise damaged from abrasive outdoor surfaces, for example a patio surface. Additionally, the glide feet 12 attached to the furniture bottommost surfaces protect the outdoor surface from being damaged by the furniture 10. Each of the plurality of glide feet 12 represented in FIG. 1 are constructed in substantially the same manner and have substantially the same appearance. Therefore, only one glide foot 14 will be described herein, with it being understood that the other glide feet 12 have substantially the same construction.

FIGS. 2-6 show representations of a first embodiment of the glide foot 14. The glide foot 14 is basically constructed of a housing 16 and an amount of material 18 added to the housing to adjustably vary the weight of the glide foot 14.

The glide foot housing 16 is constructed of a plastic material or other equivalent material that is conventionally used in constructing a glide foot for outdoor furniture. Referring to FIGS. 2-6, a base 20 of the housing 16 is constructed with a flat rectangular bottom surface 22, and an opposite rectangular and curved or trough shaped top surface 24. The housing base also has rectangular, opposite side surfaces 26, 28 and rectangular opposite front 32 and a rear 34 surfaces.

A pair of generally C-shaped flanges 36, 38 project upwardly from the opposite sides of the base 20 to distal edges 42, 44 of the flanges positioned above the top surface 24. The flanges 36, 38 extend the length of the housing base top surface 24. The opposed interior surfaces 46, 48 of the respective flanges 36, 38 and the base top surface 24 define a generally circular surface that is dimensioned to receive a bottommost member of the piece of outdoor furniture 10 having a circular cross-section within the circular surface. For outdoor furniture having bottommost members of other cross-section configurations, the flanges can be configured to accommodate those bottommost members. The material used in constructing the housing 16 is sufficiently resilient to enable the two flanges 36, 38 to deflect away from each other when manually pressing the flanges 36, 38 onto a portion of the outdoor furniture 10 to enable the flanges 36, 38 to be snapped around the portion of outdoor furniture when removably attaching the glide foot housings 16 to the outdoor furniture.

Figure 2:
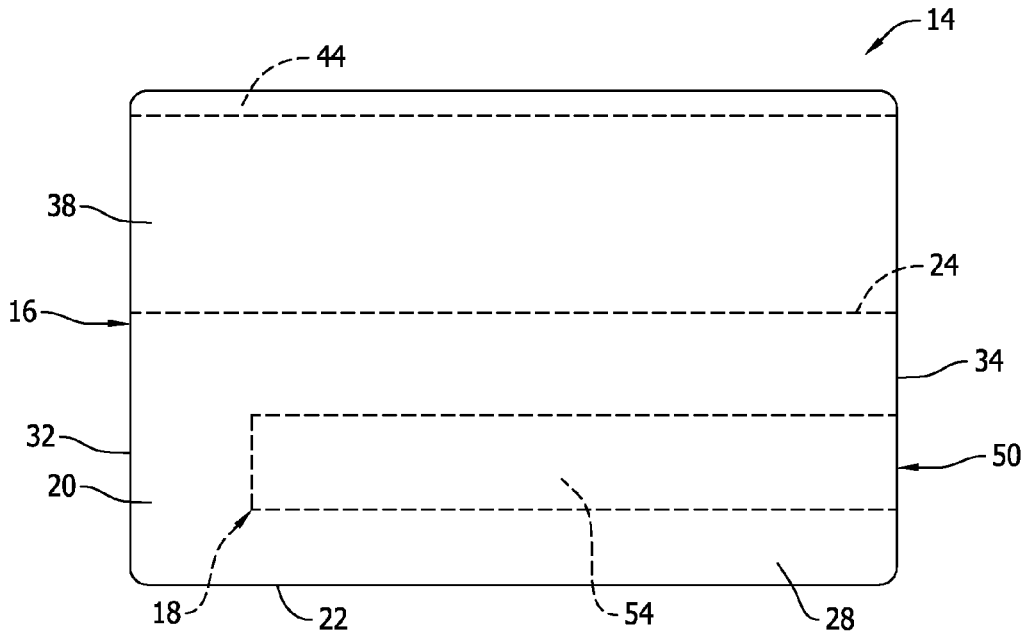
FIG. 2 is a representation of a side view of a glide foot of this disclosure, with the opposite side view being a mirror image thereof.
Figure 3:
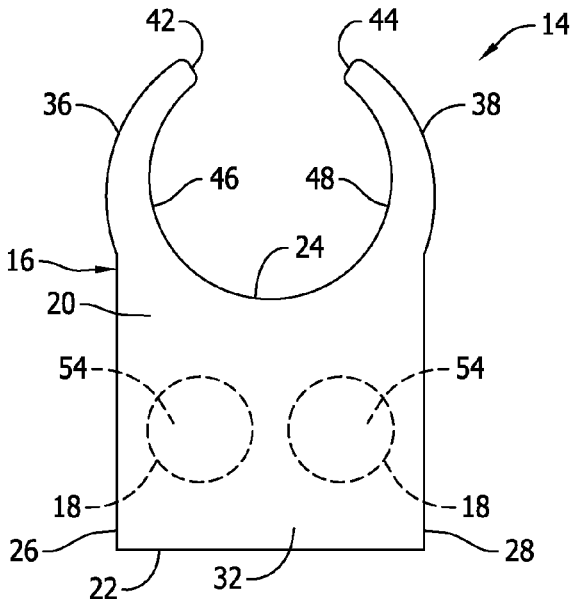
FIG. 3 is a representation of a front view of the glide foot of FIG. 2.
Figure 4:
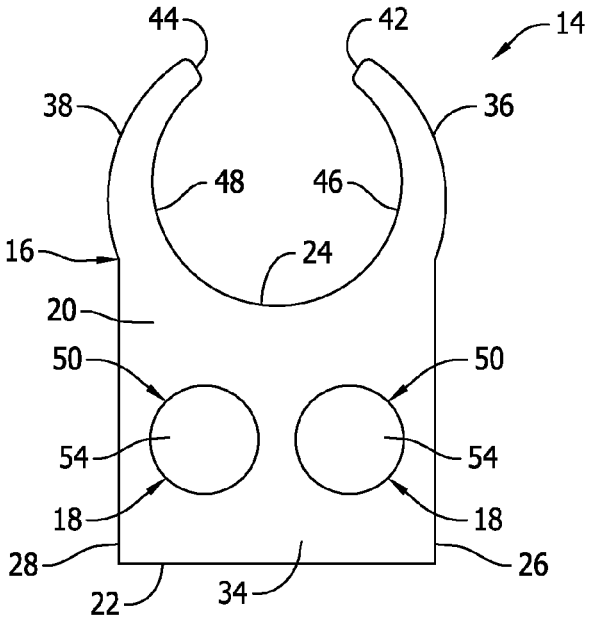
FIG. 4 is a representation of a rear view of the glide foot of FIG. 2.
Figure 5:
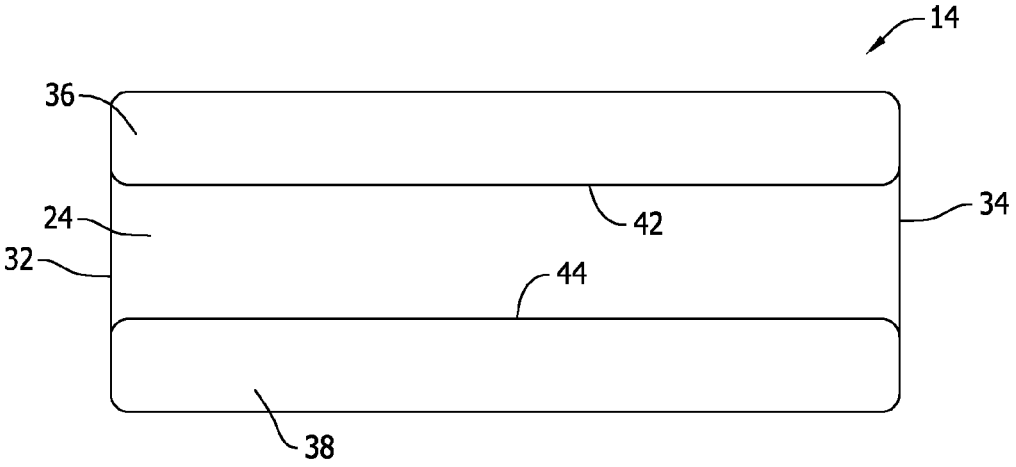
FIG. 5 is a representation of a top view of the glide foot of FIG. 2.
Figure 6:
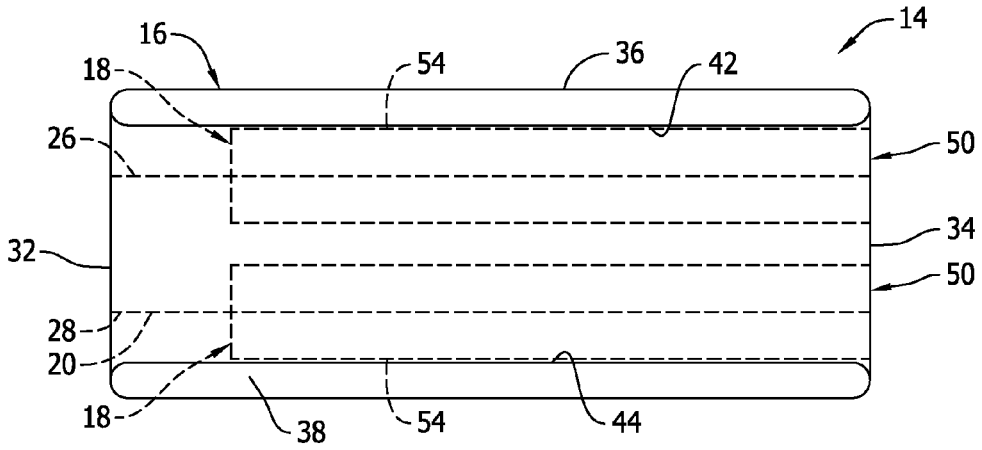
FIG. 6 is a representation of the bottom view of the glide foot of FIG. 2.

The glide foot housing 16 is also constructed with one or more holes 50 bored into the housing base 20. As represented in FIGS. 2 and 4, in the embodiment of the glide foot housing 16 shown, a pair of holes 50 are bored into the housing rear surface 34 and extend through the housing base 20 stopping just short of the housing front surface 32. Although two holes 50 are shown in the drawing figures, one hole could be formed in the housing base 20 or more than two holes could be formed in the housing base 20. Additionally, although the holes 50 shown in the drawing figures have circular cross-sections, the holes 50 could be formed with other cross-sections, for example rectangular, triangular or square cross-sections.

An amount of material 18 is added to the inside of the housing interior defined by the holes 50. The amount of material 18 added to the holes 50 adjustably increases the weight of the glide foot 14. In the drawing figures the amount of material 18 is shaped as an elongate rod 54 having a cross-section configuration that is complementary to the cross-section configuration of the holes 50. In the drawing figures two rods 54 are shown in the two holes 50. In the embodiments of the glide foot 14 having one hole or more than two holes, the number of rods 54 will correspond to the number of holes. The rods 54 can be constructed of any material that will add weight to the glide foot 14, for example a metal or a metal alloy. In embodiments of the glide foot housing 16 having a multiple of holes 50, it is not necessary that a rod 54 be positioned in each of the holes. In the two hole example shown in the drawing figures, the rod 54 could be positioned in one of the holes 50 with the other hole left empty. This further enables adjusting the weight of the glide foot 14. Additionally, the length of the glide foot housing 16 could be increased or decreased with a corresponding increase in the length of the holes 50 and the rods 54 received in the holes, or a decrease in the length of the holes 50 and the rods 54 received in the holes. This further enables adjusting the weight of the glide foot 14. With the rods 54 inserted into the holes 50, the openings of the holes in the housing rear surface 34 could be covered over by plugs, adhesives or other equivalent means to completely conceal the rods 54 in the glide foot housing 16.

Figure 7:
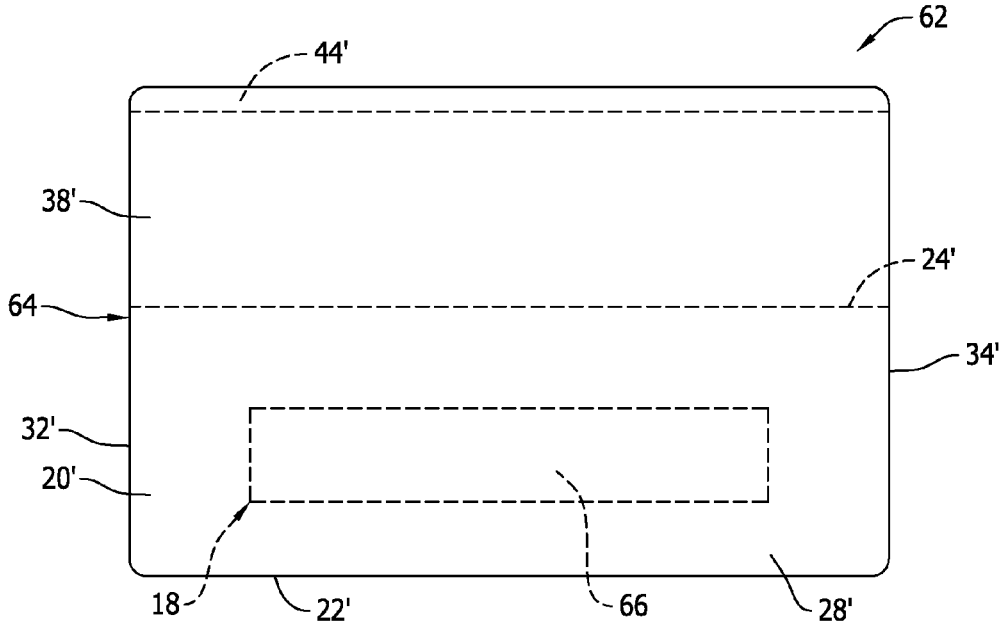
FIG. 7 is a representation of a side view of a further embodiment of the glide foot of this disclosure, with the opposite side view being a mirror image thereof.
Figure 8:
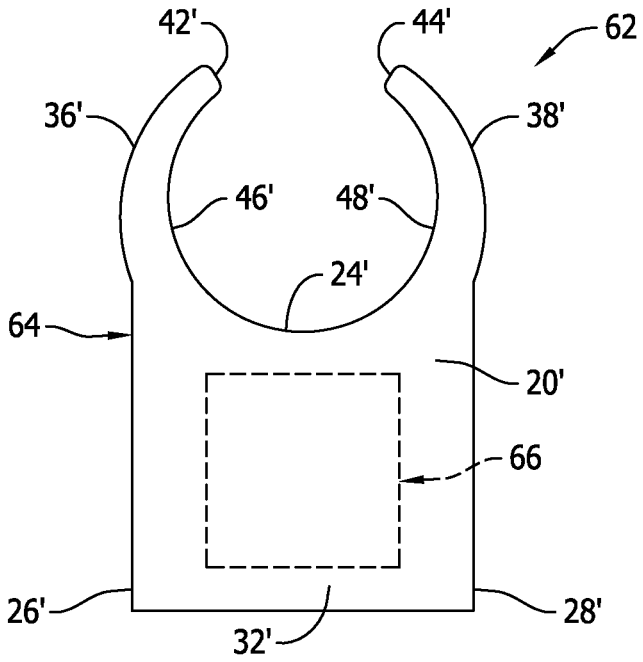
FIG. 8 is a representation of a front view of the glide foot of FIG. 7, with the opposite rear view of the glide foot being a mirror image thereof.

A further embodiment of the glide foot 62 is represented in FIGS. 7 and 8. This embodiment of the glide foot 62 also includes a housing 64 that is basically constructed in the same manner as the housing 16 of the first described embodiment. Therefore, the housing 64 of the second embodiment will not be described in detail. The component parts of the housing 64 of the second embodiment are labeled in FIGS. 7 and 8 with the same reference numbers employed in describing the construction of the housing 16 of the first embodiment, with a numbers being followed by a prime "'".

The housing 64 of the second embodiment differs from the housing 16 of the first embodiment in that the amount of material 66 provided inside the housing interior to add weight to the glide foot is a solid piece of material 66. The piece of material 66 can be any material that adds weight to the glide foot 62, for example a metal or a metal alloy. The housing 64 is formed or molded over the piece of material 66 completely encapsulating the piece of material 66 inside the housing 64. Changing the size of the piece of material 66 adjusts the weight of the glide foot 62.

The plurality of glide foot housings 16, 64 can be attached at different locations on the bottommost surfaces of the piece of outdoor furniture 10 as represented in FIG. 1 to adjustably add to the weight of the furniture. With the rods 54 and/or the solid piece of material 66 being concealed in the interiors of the respective glide foot housings 16, 64, and the glide foot housings 16, 64 having the aesthetic appearance of a typical outdoor furniture glide foot, the glide foot housings 16, 64 of this disclosure adjustably add weight to the furniture 10 without detracting from the aesthetic appearance of the furniture 10.

As various modifications could be made in the construction of the glide foot and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. An outdoor furniture glide foot comprising:

a housing constructed of a plastic material, the housing having a hollow interior, the housing being configured to be removably attached to a bottommost surface of a piece of outdoor furniture where the housing is positioned on the piece of outdoor furniture to engage with and support the piece of outdoor furniture on an outdoor surface, and prevents the bottommost surface of the piece of outdoor furniture from contacting the outdoor surface, the housing having an exterior bottom surface, the housing having an exterior top surface at an opposite side of the housing from the exterior bottom surface, the housing having exterior sides surfaces on opposite sides of the housing, the exterior side surfaces extent upwardly from the opposite sides of the exterior bottom surface, and the housing having an exterior front surface and an exterior rear surface on opposite ends of the housing, the exterior front surface and the exterior rear surface extending upwardly from opposite ends of the exterior bottom surface;

the hollow interior being between and spaced from the exterior bottom surface and the exterior top surface, the hollow interior being between and spaced from the exterior side surfaces, the hollow interior being between the exterior front surface and the exterior rear surface and spaced from the exterior front surface;

a hole through the exterior rear surface, the hole extending through the housing spaced between the exterior bottom surface and the exterior top surface and spaced between the exterior side surfaces, the hole communicating with the hollow interior; and, an amount of material inside the hollow interior, the amount of material being different from the housing material, the amount of material inside the hollow interior being configured to be inserted through the hole and into the hollow interior and removed from the hollow interior through the hole to adjust a weight of the outdoor furniture glide foot.

2. The outdoor furniture glide foot of claim 1, further comprising:

the housing being one of a plurality of separate, like housings that are each removably attachable to a bottommost surface of the piece of outdoor furniture.

3. The outdoor furniture glide foot of claim 2, further comprising:

the plurality of separate, like housings having exterior appearances that are substantially identical.

4. The outdoor furniture glide foot of claim 2, further comprising:

each of the plurality of separate, like housings having an aesthetic appearance of an outdoor furniture glide foot that conceals the amount of material inside the hollow interior and adds weight to the piece of outdoor furniture.

5. The outdoor furniture glide foot of claim 2, further comprising:

a piece of outdoor furniture; and, the plurality of separate, like housings each being removably attached to the piece of outdoor furniture.

6. The outdoor furniture glide foot of claim 1, further comprising:

the amount of material being a solid piece of material; and, the housing completely encapsulating the piece of material.

7. The outdoor furniture glide foot of claim 1, further comprising:

the housing exterior top surface being configured to engage against the bottommost surface of the piece of outdoor furniture when removably attaching the housing to the piece of outdoor furniture.

8. The outdoor furniture glide foot of claim 7, further comprising:

the hole having a cross-section configuration; and, the amount of material being shaped as a rod, the rod having a cross-section configuration that is complementary to the cross-section configuration of the hole enabling the rod to be inserted into the hole.

9. The outdoor furniture glide foot of claim 1, further comprising:

the exterior bottom surface being flat.

10. The outdoor furniture glide foot of claim 8, further comprising:

the hole being one hole of a plurality of like holes in exterior rear surfaces of the housing; and, the rod being one of a plurality of like rods that are insertable into and removable from the plurality of holes.

11. An outdoor furniture glide foot comprising:

a housing constructed of a plastic material, the housing having a hollow interior, the housing having an exterior top surface and an opposite exterior bottom surface, an exterior front surface and an opposite exterior rear surface and opposite exterior side surfaces, the housing having a pair of flanges with C-shaped cross-sections extending upwardly from the opposite exterior side surfaces of the housing over the exterior top surface of the housing, the flanges being resiliently deflectable away from each other enabling the flanges to be manually snapped over opposite sides of a member of a piece of outdoor furniture to removably attach the housing to the piece of outdoor furniture, the housing being configured to be attached to the piece of outdoor furniture and being configured to support and separate the member of the piece of outdoor furniture from an outdoor surface on which the piece of outdoor furniture is placed;

the hollow interior being between and spaced from the exterior bottom surface and the exterior to surface, the hollow interior being between and spaced from the exterior side surfaces, the hollow interior being between the exterior front surface and the exterior rear surface and spaced from the exterior front surface;

a hole through the exterior rear surface, the hole extending through the housing spaced between the exterior bottom surface and the exterior top surface and spaced between the exterior side surfaces, the hole communicating with the hollow interior; and, an amount of material inside the hollow interior, the amount of material being different from the housing material, the amount of material inside the hollow interior being configured to be inserted through the hole and into the hollow interior and being configured to be removed from the hollow interion intprior through the hole to adjust a weight of the glide foot.

12. The outdoor furniture glide foot of claim 11, further comprising:

the housing being one of a plurality of separate, like housings that are each removably attachable to the piece of outdoor furniture.

13. The outdoor furniture glide foot of claim 12 further comprising:

the plurality of separate, like housings having exterior appearances that are substantially identical.

14. The outdoor furniture glide foot of claim 12, further comprising:

each of the plurality of separate, like housings having an aesthetic appearance of an outdoor furniture glide foot that conceals the amount of material inside the hollow interior and adds weight to the piece of outdoor furniture.

15. The outdoor furniture glide foot of claim 12, further comprising:

a piece of outdoor furniture; and, the plurality of separate, like housings being attached to the piece of outdoor furniture.

16. The outdoor furniture glide foot of claim 11, further comprising:

the amount of material being a solid piece of material; and, the housing completely encapsulating the piece of material.

17. The outdoor furniture glide foot of claim 11, further comprising:

the exterior bottom surface being flat.

18. The outdoor furniture glide foot of claim 11, further comprising:

the hole having a cross-section configuration; and, the amount of material being shaped as a rod, the rod having a cross-section configuration that is complementary to the hole cross-section configuration enabling the rod to be inserted into the hole and removed from the hole.

19. The outdoor furniture glide foot of claim 18, further comprising:

the hole being one hole of a plurality of like holes in the exterior rear surface of the housing; and, the rod being one of a plurality of the like rods that are insertable into the plurality of holes and removable from the plurality of holes.

20. A method of adjustably adding weight to outdoor furniture comprising:

constructing a glide foot for the outdoor furniture with a housing of a plastic material, constructing the housing with a hollow interior, positioning the hollow interior between and spaced from an exterior bottom surface and an exterior top surface of the housing, positioning the hollow interior between and spaced from exterior side surfaces of the housing, and positioning the hollow interior between an exterior front surface and an exterior rear surface of the housing and spaced from the exterior front surface;

providing a hole through the rear surface, extending the hole through the housing spaced between the exterior bottom surface and the exterior top surface and spaced between the exterior side surfaces, and communicating the hole with the hollow interior, constructing the housing to be removably attachable to a bottommost surface of the piece of outdoor furniture where the housing is positioned on the piece of outdoor furniture to engage with and support the piece of outdoor furniture on an outdoor surface and prevent the bottommost surface of the piece of outdoor furniture from contacting the outdoor surface; and, adding an amount of material inside the hollow interior where the amount of material is different from the housing material, adding the amount of material by inserting the amount of material through the hole and into the hollow interior and removing the amount of material from the hollow interior through the hole in adjusting the amount of material inside the hollow interior to adjust a weight of the glide foot; and, releasably attaching the glide foot to the piece of outdoor furniture.

* * * * *